US006474482B2

(12) United States Patent
Manix et al.

(10) Patent No.: US 6,474,482 B2
(45) Date of Patent: Nov. 5, 2002

(54) INFLATION NEEDLE STORAGE RACK

(76) Inventors: Paul D. Manix, 22627 Hatteras St., Woodland Hills, CA (US) 91367; Mary D. Manix, 22627 Hattaras St., Woodland Hills, CA (US) 91367

( * ) Notice: Subject to any disclaimer, the term of this patent is extended or adjusted under 35 U.S.C. 154(b) by 0 days.

(21) Appl. No.: 09/731,097

(22) Filed: Dec. 6, 2000

(65) Prior Publication Data

US 2002/0066707 A1 Jun. 6, 2002

(51) Int. Cl.[7] ..... A47F 7/00
(52) U.S. Cl. ..... 211/70.6
(58) Field of Search ..... 211/70.6, 87.01, 211/60.1, 85.7, 85.13, 69, 69.8, 89.01, 13.1

(56) References Cited

U.S. PATENT DOCUMENTS 1,538,849 A * 5/1925 Eger
2,397,416 A 3/1946 Haley
2,974,804 A * 3/1961 Maro
4,030,599 A * 6/1977 Bruni
4,294,365 A * 10/1981 Henderson
4,345,688 A * 8/1982 De Boer
4,383,615 A 5/1983 Aquino
4,415,092 A * 11/1983 Boyer
4,503,972 A 3/1985 Nelligan et al.
4,813,551 A * 3/1989 Kuo
4,871,074 A * 10/1989 Bryson et al.
5,129,528 A * 7/1992 Eidsmoe et al.
5,188,242 A * 2/1993 Smith
5,505,316 A * 4/1996 Lee
5,570,794 A 11/1996 Drower
5,641,079 A * 6/1997 Schmidt
5,678,700 A * 10/1997 Crosson, Jr.

* cited by examiner

*Primary Examiner*—Alvin Chin-Shue
*Assistant Examiner*—Sarah Purol
(74) *Attorney, Agent, or Firm*—Sanford Astor

(57) ABSTRACT

An inflation needle storage rack comprising one or more elongated members each having two or more cross-members, each of the cross-members having a slotted hole or a hole adapted to hold one inflation needle. The elongated bases have a double-sided adhesive attached to the rear thereof, so that the outer side of the adhesive may be attached to any convenient surface determined by the user, such as a wall, gym bag, pump, or other location, to prevent loss of the inflation needles. In the alternative, the elongated member has a hole therein to pass a chain or string to hang the unit on a nail, key ring, gym bag handle, air pump handle, or other location.

8 Claims, 4 Drawing Sheets

INFLATION NEEDLE STORAGE RACK

This invention is described in our Disclosure Document #476325 filed Jun. 29, 2000.

BACKGROUND OF THE INVENTION

Inflation needles are commonly needed around the home for a variety of uses. Some of these uses are for inflation of sports balls, some tires, air mattresses, and the like. Inflation needles are usually sold three to a package. Once the cardboard and plastic package is opened and the first needle is used, the other two quickly get lost. The first needle is often left attached to the hose of an air pump and gets bent. It breaks when you attempt to straighten it out.

The search for an inflation needle usually starts on the way out of the door before a game, or a camping trip, and requires a quick stop at the sporting goods store, because the ones previously purchased cannot be found.

Storage racks for some small articles are also known, such as the rack described in U.S. Pat. No. 5,570,794 to Drower. These racks, however, are not suited to inflation needles, because the needles are so small, need to have a secure holder and need to be able to be attached to a specific location at the choice of the user, which may be fixed or portable.

SUMMARY OF THE INVENTION

The inflation needle storage rack of the present invention comprises one or more elongated members each having two or more cross-members, each of the cross-members having a slotted hole or a hole adapted to hold one inflation needle. The elongated members have a double-sided adhesive, one side attached to the rear of each elongated member, so that the outer side of the adhesive may be attached to any convenient surface determined by the user, such as a wall, gym bag, pump, tool box or other location, to prevent loss of the inflation needles.

This provides an easy, practical place to store inflation needles so that they are easily located when needed. The storage rack is made of either a pliable or rigid material, such as plastic, and has holes and/or slotted holes in cross-members to accomodate the stems of the inflation needles, which fit snugly into the holes or slots. The adhesive backing allows the storage rack to be attached to almost any surface.

OBJECTS OF THE INVENTION

Accordingly, several objects and advantages of the invention are as follows:

It is an object of the present invention to provide an inflation needle storage rack to prevent loss of the needles.

Another object of the invention is to provide such a device so that the storage needles are always available at a known location, when needed.

Yet another object of the invention is to provide an inflation needle storage rack which holds one or more inflation needles and can be attached to almost any surface.

DETAILED DESCRIPTION OF THE INVENTION

Figure 1:
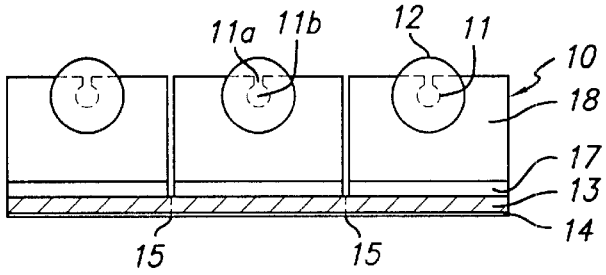
FIG. 1 is a top plan view of the inflation needle storage rack of this invention.
Figure 4:
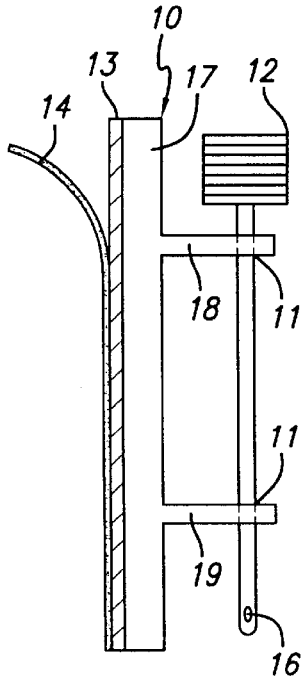
FIG. 4 is a side view.
Figure 2:
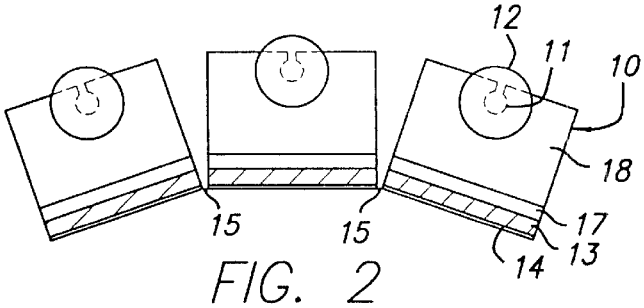
FIG. 2 is another top plan view with the multiple holders separated.
Figure 3:
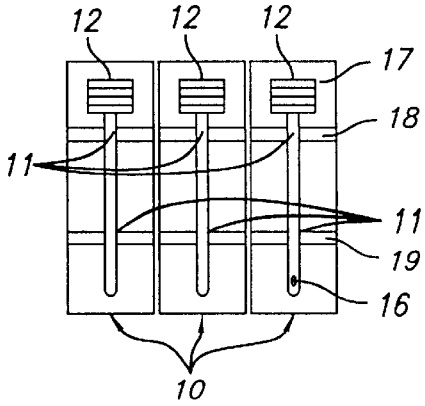
FIG. 3 is a front view.
Figure 5:
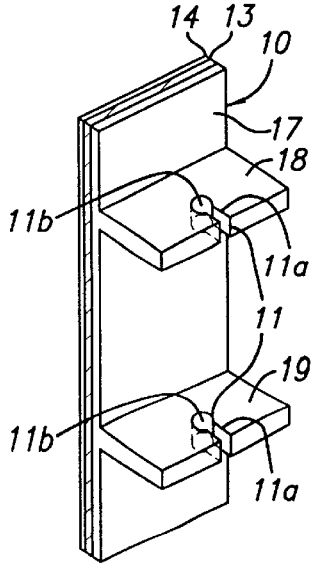
FIG. 5 is a perspective view of one of the holders.
Figure 6:
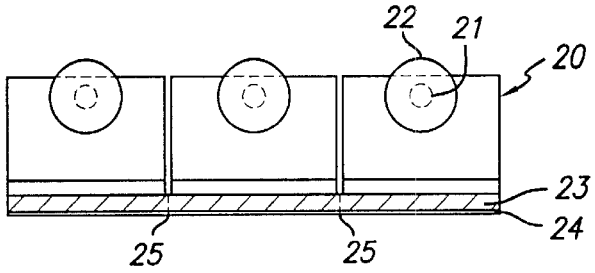
FIG. 6 is a top plan view of another embodiment.
Figure 9:
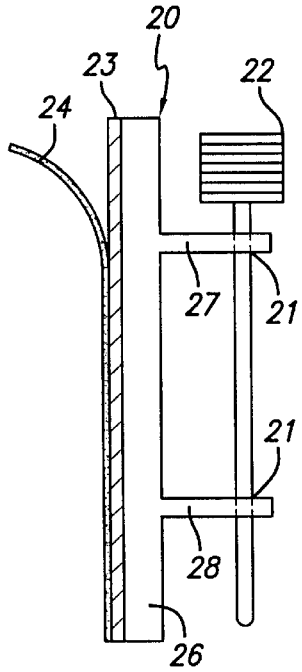
FIG. 9 is a side view thereof.
Figure 7:
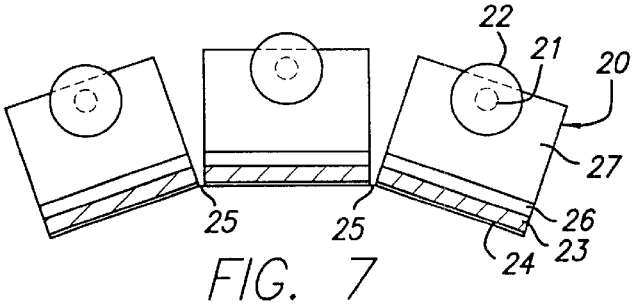
FIG. 7 is another top plan view of the embodiment.
Figure 8:
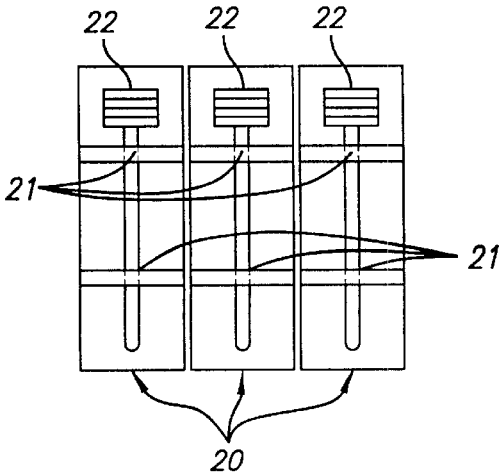
FIG. 8 is a front view of the embodiment.
Figure 10:
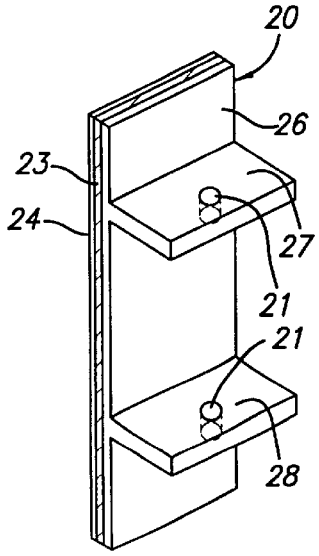
FIG. 10 is a perspective view thereof.

Referring now to the drawings, there is shown in FIGS. 1–5 the inflation needle storage rack 10 of this invention comprising a rigid or pliable material which has an elongated member 17 and two horizontal cross-members 18 and 19. Storage rack 10 is shown with three identical sections, however there can be from one to a plurality of identical sections, as desired.

Affixed to the back of elongated member 17 is an adhesive substance 13 covered by a peel-off protective sheet 14. Sheet 14 is peeled off of adhesive 13 at the time rack 10 is to be affixed to the desired surface, such as a wall, tool box, gym bag or other desired surface. The double-sided adhesive 13 is a commonly available product, such as "Scotch" brand mounting tape.

Rack 10 with its three sections can be separated, if desired, by detaching one or more sections at perforation lines 15. In this manner rack 10 can be used as one unit to hold three inflation needles or can be separated into two or three sections to hold three needles in three separate locations.

Horizontal cross-members 18 and 19 each have an slotted hole opening 11 comprising an slot 11*a* and a round hole portion 11*b*, into which an inflation needle 12 can be placed. The diameter of open slots 11*a* of openings 18 and 19 is substantially the same as that of the inflation needle stem, so that needle 12 is frictionally held. Needle 12 can be inserted and removed from rack 10 by either pushing needle 12 down through the round hole portion 11*b* of opening 11 or snapping it into opening 11 by pushing needle 12 through slot 11*a* into round hole portion 11*b*.

Inflation needle 12 has air passage opening 16 through which air passes from needle 12 into the object being filled with air. Some inflation needles have an air exit hole 16 as shown and some have the air exit hole at the bottom of the needle.

Referring now to FIGS. 6–10 there is shown another embodiment in which rack 20 has elongated member 26 and horizontal cross-members 27 and 28. Horizontal cross-members 27 and 28 each have holes 21 to receive inflation needle 22 which must be inserted down from the top and can only be inserted and removed by pushing needle down into or pulling it up out of holes 21. Holes 21 have substantially the same diameter as the stem of needle 22, thus frictionally holding needle 22. By frictionally holding needle 22, it cannot fall out of rack 20 and cannot be lost.

Rack 10 has double sided adhesive 23 with protective peel-off layer 24, similar to FIGS. 1–5.

Figure 11:
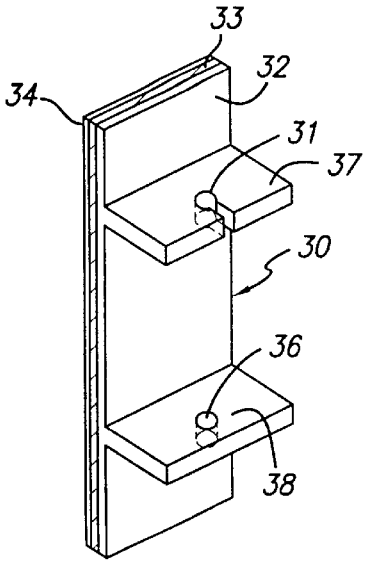
FIG. 11 is a perspective view of another embodiment.
Figure 13:
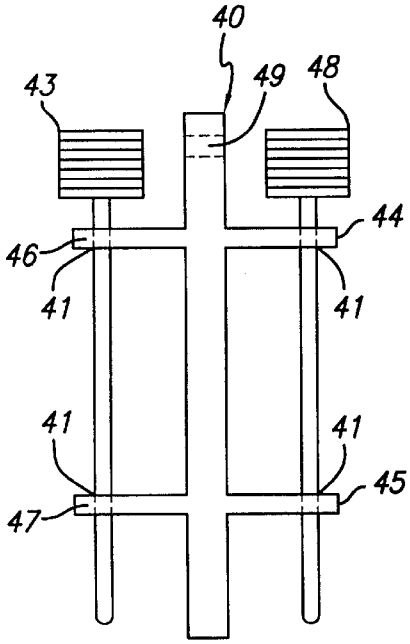
FIG. 13 is a side view of the embodiment of FIG. 12.
Figure 12:
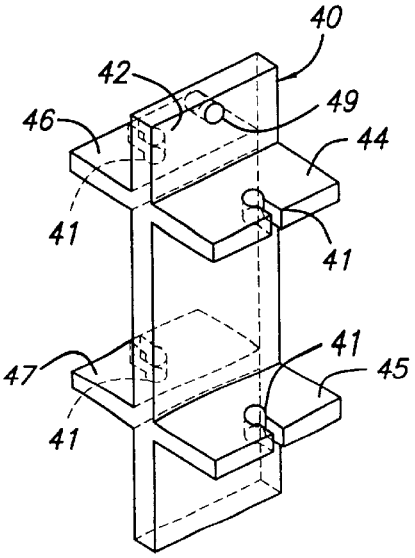
FIG. 12 is a perspective view of another embodiment.
Figure 14:
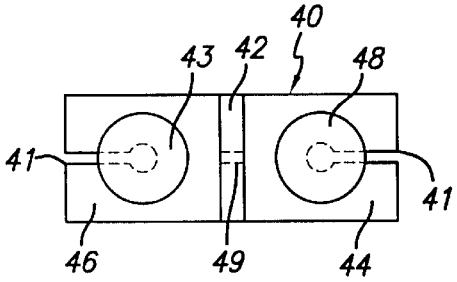
FIG. 14 is a top plan view of the embodiment of FIG. 12.
Figure 15:
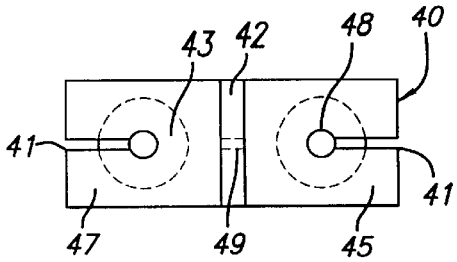
FIG. 15 is a bottom view of the embodiment of FIG. 12.

FIG. 11 depicts another embodiment in which rack 30 has elongated member 32, horizontal cross-members 37 and 38, adhesive 33 and peel-off sheet 34. Cross-member 37 has a slotted hole 31 as in FIG. 1 and cross-member 38 has a hole, as in FIG. 6. The reverse can also be done with the slotted hole at the bottom and the hole at the top.

FIGS. 12–15 depict another embodiment which is adapted to be held by a chain or string through a hole 49. The rack has elongated member 40 and four cross-members 44, 45, 46, and 47, each of which has a hole or a slotted hole 41. Elongated member 40 and cross-members 44, 45, 46, and 47 can be manufactured as one unit, such as forming the unit from plastic by injection molding or other forming process. In the alternative, two units as described in FIGS. 1–11 can be connected by the adhesive, placed back to back.

Two inflation needles 43 and 48 can be held, one on each side of elongated member 40. This embodiment is adapted to be held by a chain or string through hole 49, which can be attached around a gym bag handle, air pump handle, on a nail or key ring or any other location desired by the user.

Figure 16:
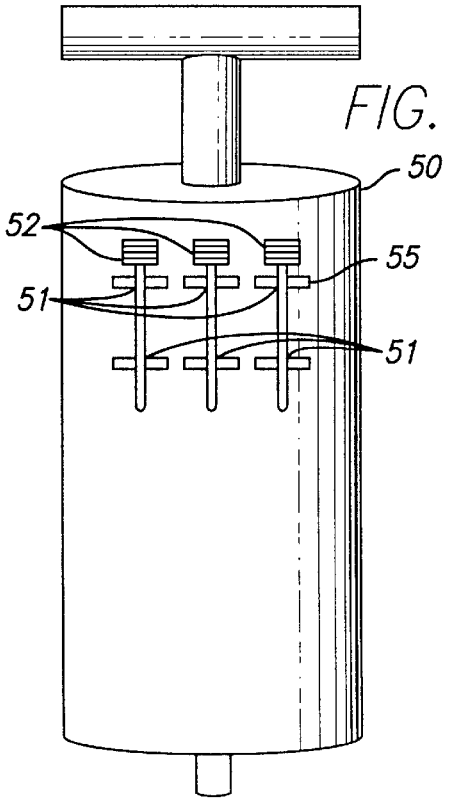
FIG. 16 is a front view of another embodiment.
Figure 18:
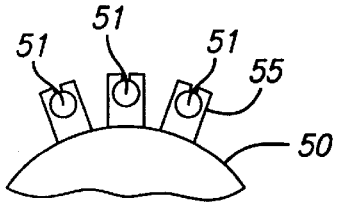
FIG. 18 is a top view of the embodiment of FIG. 18.
Figure 19:
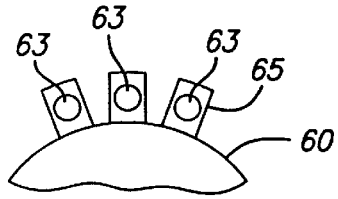
FIG. 19 is a top view of the embodiment of FIG. 19.
Figure 17:
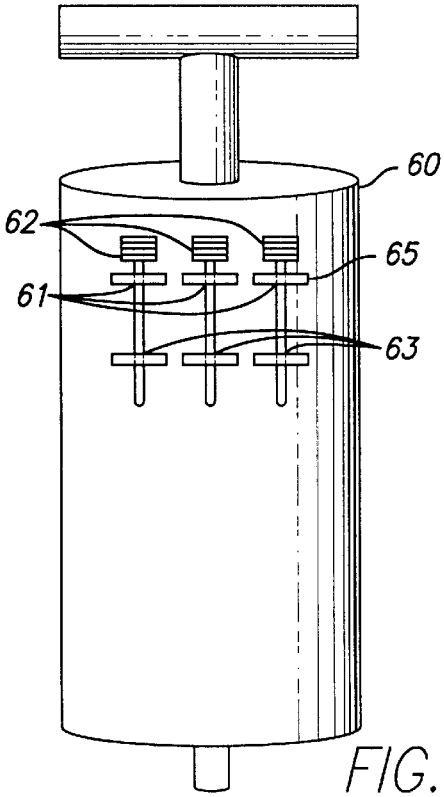
FIG. 17 is a front view of another embodiment.

FIGS. 16–19 depict two other embodiments in which the inflation needle storage racks 55 and 65 are attached directly to hand pumps 50 and 60 respectively. A unit, such as the one described in FIGS. 1 and 2, can be attached by the adhesive 13, since the unit can bend to fit the circumference of the pump. In the alternative, as shown in FIGS. 18 and 19, the storage rack can be manufactured as a part of the pump. FIGS. 16 and 18 show three inflation needles 52 in rack 55 having slotted holes 51. FIGS. 17 and 19 show three inflation needles 62 in rack 65 having slotted holes 61 and holes 63.

The inflation needle storage rack can be manufactured from any convenient material, a plastic such as PVC (polyvinyl chloride) or ABS (Acrylonitryl-butadyene-styrene) being the easiest to manufacture. However, the rack could be made of metal, wood or other material.

While the racks shown have three units to hold needles, the rack could have from one to a plurality of any convenient number of units.

Having thus described the invention,

We claim:

1. An inflation needle storage rack comprising one or more elongated vertical members each having two or more horizontal cross-members, each of the cross-members having a slotted hole or a hole adapted to frictionally hold one inflation needle tightly enough that it cannot fall out of the rack, a double-sided adhesive attached to the rear of each elongated vertical member.

2. The device of claim 1 in which each cross-member has a slotted hole adapted to frictionally hold one inflation needle.

3. The device of claim 1 in which each cross-member has a hole adapted to frictionally hold one inflation needle.

4. The device of claim 1 comprising two cross-members in which one cross-member has a hole and the other cross-member has a slotted hole adapted to frictionally hold one inflation needle.

5. An inflation needle storage rack comprising one or more elongated members each elongated member having two or more cross-members located on each side of each elongated member, each of the cross-members having a slotted hole or a hole adapted to frictionally hold one inflation needle tightly enough that it cannot fall out of the rack.

6. The device of claim 5 in which each elongated member has a hole therein, hanging means which fit through said hole to hang the storage rack.

7. The device of claim 5, in which two elongated members, having cross-members on one side only are attached together by their adhesive layers.

8. The device of claim 1 further comprising perforation lines between adjacent elongated members.

* * * * *